US008012406B2

(12) United States Patent
Yamamoto et al.

(10) Patent No.: US 8,012,406 B2
(45) Date of Patent: Sep. 6, 2011

(54) METHOD OF ARRANGING AND SETTING SPRAY COOLING NOZZLES AND HOT STEEL PLATE COOLING APPARATUS

(75) Inventors: Ryuji Yamamoto, Tokyo (JP); Yoshihiro Serizawa, Tokyo (JP); Shigeru Ogawa, Tokyo (JP); Hironori Ueno, Tokyo (JP); Masahiro Doki, Tokyo (JP); Yasuhiro Nishiyama, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 118 days.

(21) Appl. No.: 12/224,410

(22) PCT Filed: May 15, 2007

(86) PCT No.: PCT/JP2007/060308

§ 371 (c)(1),
(2), (4) Date: Aug. 25, 2008

(87) PCT Pub. No.: WO2008/032473

PCT Pub. Date: Mar. 20, 2008

(65) Prior Publication Data

US 2009/0045557 A1 Feb. 19, 2009

(30) Foreign Application Priority Data

Sep. 12, 2006 (JP) ..... 2006-247282

(51) Int. Cl.
*C21B 7/10* (2006.01)

(52) U.S. Cl. ..... 266/46; 148/637

(58) Field of Classification Search ..... 266/46, 266/113; 148/637
See application file for complete search history.

(56) References Cited

U.S. PATENT DOCUMENTS 3,300,198 A 1/1967 Clumpner et al.

FOREIGN PATENT DOCUMENTS

| | | |
|---|---|---|
| JP | 6-238320 | 8/1994 |
| JP | 08-238518 | 9/1996 |
| JP | 2004-306064 | 11/2004 |
| JP | 2005-279691 | 10/2005 |
| JP | 2006-110611 | 4/2006 |

OTHER PUBLICATIONS

International Search Report dated Aug. 14, 2007 issued in corresponding PCT Application No. PCT/JP2007/060308.
Supplementary European Search Report dated Nov. 19, 2008 issued in corresponding European Application No. 07 74 3742.

*Primary Examiner* — Scott Kastler
(74) *Attorney, Agent, or Firm* — Kenyon & Kenyon LLP

(57) ABSTRACT

The present invention relates to an apparatus for cooling a hot steel plate which is processed and constrained by constraining rolls and a method of arranging and setting spray nozzles enabling uniform cooling in a direction perpendicular to processing. In the apparatus and method of the invention, the spray nozzles are arranged so that a value of n power of the impact pressure of the cooling water on the cooling surface integrated in the processing direction between pairs of constraining rolls becomes within −20% of the highest value in the direction perpendicular to processing, where $0.05 \leqq n \leqq 0.2$.

3 Claims, 11 Drawing Sheets

Prior Art

METHOD OF ARRANGING AND SETTING SPRAY COOLING NOZZLES AND HOT STEEL PLATE COOLING APPARATUS

TECHNICAL FIELD

The present invention relates to a method of controlled cooling of hot steel plate, obtained by hot rolling, while processing it constrained by pairs of constraining rolls comprised of top and bottom constraining rolls, more particularly relates to an apparatus for cooling hot steel plate applied for obtaining a steel material excellent and uniform in shape characteristics.

BACKGROUND ART

To improve the mechanical properties, workability, and weldability of steel materials, the general practice has been for example to acceleratedly cool a high temperature state steel material right after being hot rolled while processing it on a rolling line and give the steel material a predetermined cooling history. However, the uneven cooling occurring when cooling a steel material becomes a cause of shape defects or work strain in the steel material. Fast improvement is desired to meet with the increasingly tougher demands for better quality of steel materials.

To solve these problems, there is the method of using a plurality of pairs of top and bottom constraining rolls so as to constrain the steel material and prevent heat deformation. However, even with this method, while a steel material with a good shape is obtained, sometimes residual stress inside the steel material manifests itself as deformation at the time the material is worked at the customer side. This is therefore not a fundamental solution. Therefore, uniformly cooling the steel material is the best means for solution.

As a cooling method for achieving uniform cooling, in the method of cooling by using conventional spray nozzles to spray a cooling medium, that is, water, on the steel material, the facilities have been designed so that uniform amounts of water are sprayed in the width direction of the steel material. FIG. 1 shows the nozzle arrangement of a steel material cooling apparatus using conventional plateau shaped water distribution flat sprays. The spray nozzles 1 are arranged in a line at a suitable nozzle pitch S0 in the direction perpendicular to processing so that the distribution of water in the entire region in the direction perpendicular to processing becomes uniform. In the processing direction of the steel material, the adjoining spray regions 2 are arranged so as not to interfere with each other.

However, in a cooling apparatus of this nozzle arrangement, the cooling ability becomes higher at the center of the spray ranges of the nozzles (spray regions 2) compared with the peripheries, so a uniform distribution of cooling ability cannot be obtained in the steel material in the direction perpendicular to processing and uneven cooling sometimes occurs.

As a method of using spray nozzles for uniform cooling, Japanese Patent Publication (A) No. 6-238320 discloses the method of reducing the variation in impact pressure of cooling water in a single spray range to within ±20%. Further, Japanese Patent Publication (A) No. 8-238518 proposes the method of arranging spray nozzles so that spray interference regions are formed. Further, Japanese Patent Publication (A) No. 2004-306064 concludes that uniform cooling can be achieved by having all points in the width direction of a cooled surface pass through coolant spray impact regions at least twice.

DISCLOSURE OF THE INVENTION

Japanese Patent Publication (A) No. 6-238320 does not propose a method of making the cooling ability uniform for all spray cooling ranges provided in a plurality of lines in the processing direction and direction perpendicular to processing. Further, in Japanese Patent Publication (A) No. 8-238518, outside the nozzle spray interference regions, the cooling abilities become higher at the centers of the nozzle spray ranges, so even if using the cooling method of Japanese Patent Publication (A) No. 8-238518, a uniform distribution of cooling ability is not obtained. Further, in the method of Japanese Patent Publication (A) No. 2004-306064, when arranging spray nozzles, having distributions of cooling abilities in the coolant impact regions, in a line in the processing direction, despite the coolant spray impact regions being passed at least twice, a difference in cooling ability occurs between the centers of the impact regions and the ends of the impact regions and therefore a uniform distribution of cooling ability cannot be obtained.

The present invention was made to solve the above problems and has as its object to provide a method of arranging and setting spray nozzles of a spray cooling apparatus enabling uniform cooling in a direction perpendicular to processing and to provide a method of arranging and setting spray nozzles of a spray cooling apparatus using two or more types of nozzles differing in amounts of water and spray regions to obtain a broad range of adjustment of amounts of water.

The method of arranging and setting spray nozzles of the present invention has as its gist the following (1) to (4) to achieve uniform cooling of hot steel plate in the direction perpendicular to processing:

(1) A method of arranging and setting spray nozzles of a processing and cooling apparatus provided with a plurality of pairs of constraining rolls for constraining and processing hot steel plate and provided with a plurality of lines of spray nozzles, able to control the amounts of cooling water sprayed, between pairs of constraining rolls in the processing direction and/or direction perpendicular to processing, said method of arranging and setting spray nozzles characterized by arranging the spray nozzles so that a value of an n power of the impact pressures of the cooling water on the cooling surface integrated in the processing direction between pairs of constraining rolls becomes within −20% of the highest value in the direction perpendicular to processing, where, $0.05 \leqq n \leqq 0.2$ (2) A method of arranging and setting spray nozzles as set forth in (1), characterized by using a plurality of types of nozzles differing in amounts of water or spray regions of cooling water for each line of nozzles between pairs of constraining rolls.

(3) A method of arranging and setting spray nozzles as set forth in (1) or (2), characterized in that the spray nozzles have structures enabling mixed spraying of water and air.

(4) A hot steel plate cooling apparatus characterized by setting the arrangement of spray nozzles using the method as set forth in any one of (1) to (3).

BRIEF DESCRIPTION OF THE DRAWINGS

FIG. 2(*b*) is a graph showing the relationship between the cooling water impact pressure and cooling ability in the same nozzle.

FIG. 2(*c*) gives a (i) side view and (ii) front view showing the positional relationship between a spray nozzle 1 and ranges M1, M2, and M3 in the spray region 2.

FIG. 3(*b*) gives explanatory views of the spray region of a full cone nozzle, where (i) is a side view and (ii) is a front view.

FIG. 5(*b*) gives a (i) side view and (ii) front view for explaining a cooling test arrangement arranging nozzles in a zigzag configuration in two lines in the direction perpendicular to processing.

FIG. 6(*b*) is a graph showing the distribution of cooling ability and distribution of values of 0.1 power of cooling water impact pressure integrated in the processing direction normalized by the maximum integrated value in the direction perpendicular to processing in the nozzle arrangement of FIG. 5(*b*).

FIG. 10(*b*) gives a (i) side view and (ii) front view for explaining a cooling test apparatus used for studying the present invention, that is, a cooling test apparatus using a method of setting spray nozzles of the present invention.

FIG. 11(*b*) is a graph comparing the distribution of impact pressure of the cooling water in the direction perpendicular to the steel plate between the cooling apparatus of the present invention and the conventional cooling apparatus.

FIG. 11(*c*) is a graph comparing the distribution of surface temperature of the steel material in the direction perpendicular to the steel plate between the cooling apparatus of the present invention and the conventional cooling apparatus.

BEST MODE FOR CARRYING OUT THE INVENTION

The inventors investigated and researched the factors contributing to cooling in spray cooling. The experimental results of this R&D will be explained with reference to the drawings.

Figure 1:
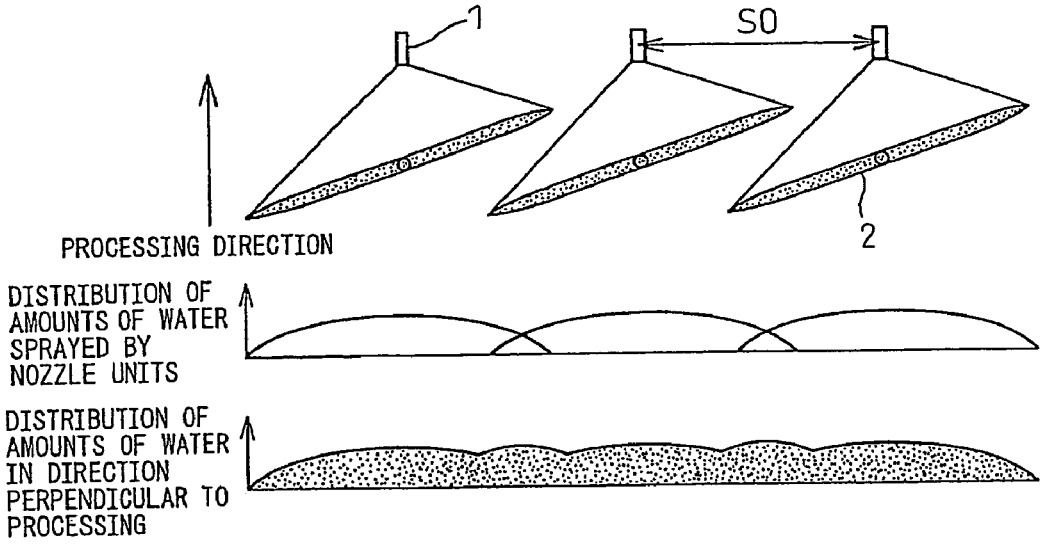
FIG. 1 is a view of a conventional nozzle arrangement resulting in constant amounts of water in the direction perpendicular to processing.
Figure 2A:
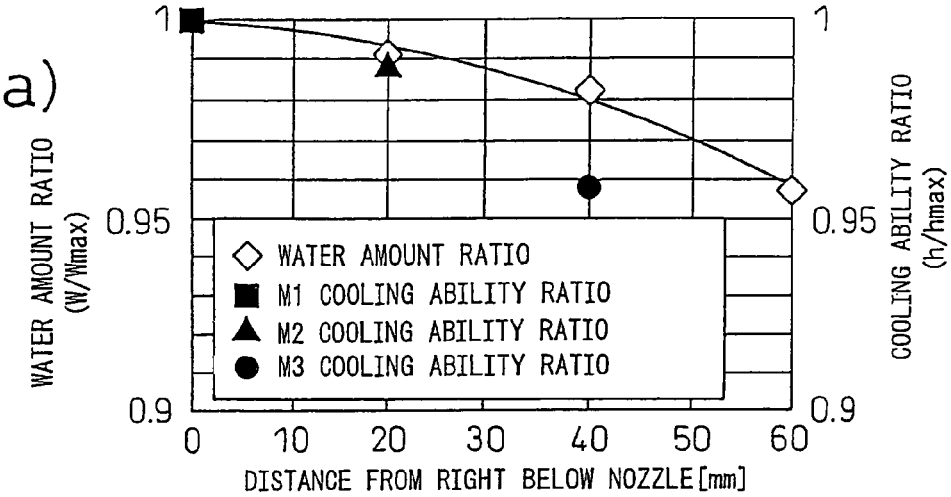
FIG. 2(*a*) is a graph showing the relationship between the amount of water and cooling ability in the same nozzle.
Figure 2B:
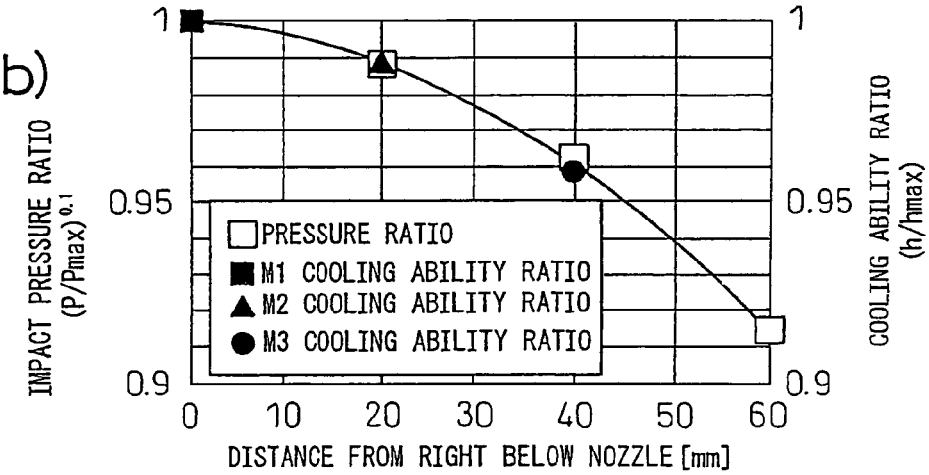
Figure 2C:
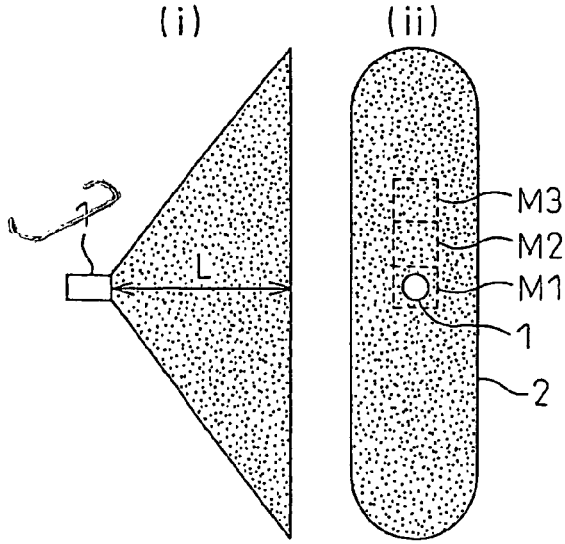

When cooling a stationary member to be cooled by a single nozzle, as shown in FIG. 2(*c*), the average values of the amounts of water and cooling abilities were measured in the 20 mm×20 mm ranges M1, M2, and M3 of the 300 mm×40 mm range (spray region 2) of the spray of cooling water from an oblong nozzle (spray nozzle 1) with a flow rate of 100 L/min and a header pressure of 0.3 MPa arranged at a position where the distance L from the front end of the nozzle to the cooling surface becomes 150 mm and were divided by the highest value of the measured values (amount of water and cooling ability of range M1) to make them dimensionless (normalize) them. The range M1 is the range of 20 mm×20 mm positioned at the true front surface of the spray nozzle 1, the range M2 is the range of 20 mm×20 mm adjoining the range M1, and the range M3 is the range of 20 mm×20 mm adjoining the range M2. These ranges M1, M2, and M3 are arranged in series along the longitudinal direction of the spray region 2. Note that for the cooling ability, a cooling test was run using as the cooled member rolled steel material for general structures (SS400) of a plate thickness of 20 mm heated to 900° C. The heat transfer coefficient measured at the time of a surface temperature of the steel material of 300° C. was used for evaluation as the cooling ability.

Regarding the distribution of cooling ability in the spray region 2, if comparing the cooling abilities of the ranges M1, M2, and M3, as shown in FIG. 2(*a*), it is learned that a difference occurs in the cooling ability even at positions in the same nozzle spray where the amounts of water are substantially the same. That is, in the case of spray cooling, the factors contributing to cooling are not just the amounts of water. It is believed that various factors such as the speed of the liquid drops, the size of the liquid drops, the angle of impact of the liquid drops on the cooled member, etc. complicatedly act.

The inventors discovered that the cooling factor able to comprehensively express these diverse cooling factors, including the amounts of water, is the impact pressure of the cooling water.

The inventors measured the distribution of impact pressure of cooling water averaged at the 20 mm×20 mm ranges M1, M2, and M3 using the same nozzle and the same arrangement as those used for the above FIG. 2(*a*). This is shown together with the distribution of cooling ability in FIG. 2(*b*). Note that as the ratio of impact pressures, the measured value of the impact pressure of the cooling water (average value) divided by the highest value of the measured values to render it dimensionless (normalize it) and further multiplied by the power of 0.1 was used. In this way, the 0.1 power of the impact pressure of the cooling water and the cooling ability match extremely well.

Further, the inventors investigated the relationship between the cooling water impact pressure directly under a nozzle and cooling ability using eight types of nozzles differing in amounts of water, header pressures, and spray regions shown in Table 1.

TABLE 1

| | Type of nozzle | Flow rate [l/min] | Header pressure [MPa] | Spray region [mm × mm] | Cooling water impact pressure right under nozzle [MPa] |
|---|---|---|---|---|---|
| A | oblong 1 | 100 | 0.3 | 300 × 40 = 12000 | 0.0052 |
| B | oblong 2 | 65 | 0.125 | 350 × 50 = 17500 | 0.0019 |
| C | oblong 2 | 100 | 0.3 | 350 × 50 = 17500 | 0.0026 |
| D | oblong 3 | 33 | 0.3 | 250 × 70 = 17500 | 0.0021 |
| E | oblong 4 | 65 | 0.5 | 250 × 60 = 15000 | 0.0069 |
| F | oblong 4 | 50 | 0.3 | 250 × 60 = 15000 | 0.0053 |
| G | oblong 5 | 100 | 0.3 | 250 × 60 = 15000 | 0.0013 |
| H | full cone | 100 | 0.3 | φ70 = 3850 | 0.0077 |

Figure 3A:
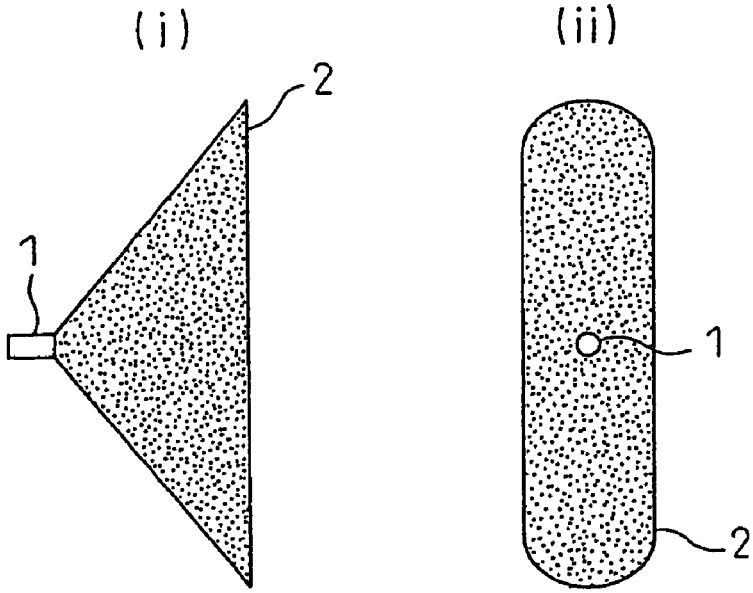
FIG. 3(*a*) gives explanatory views of the spray region of an oblong nozzle, where (i) is a side view and (ii) is a front view.
Figure 3B:
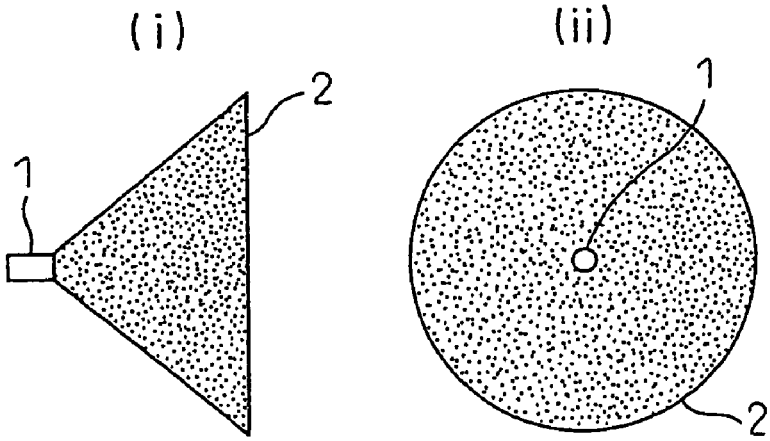
Figure 4:
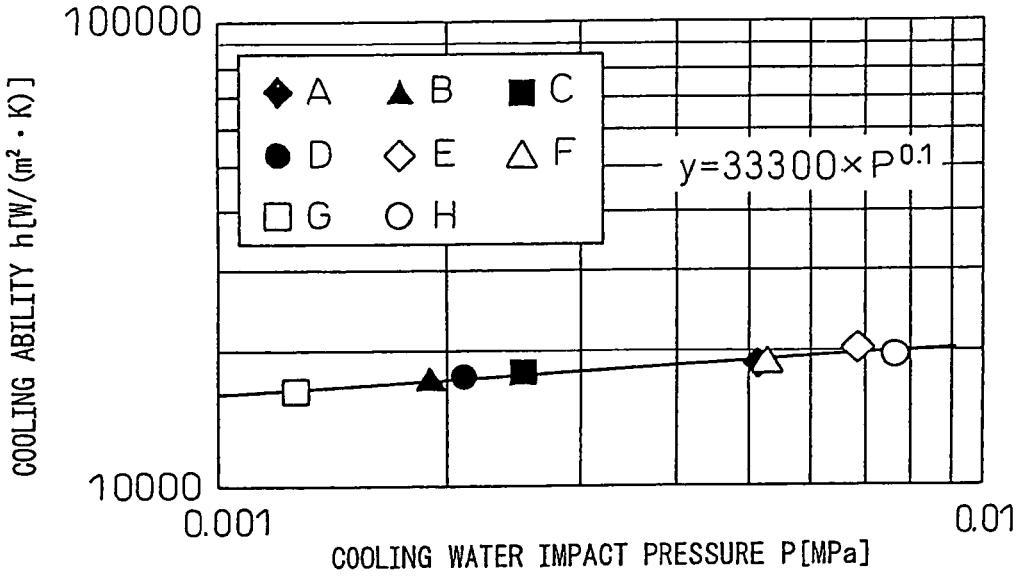
FIG. 4 is a graph showing the relationship between the cooling water impact pressure and cooling ability for eight types of nozzles shown in FIG. 3(*a*) and FIG. 3(*b*) differing in amounts of water, header pressures, and spray regions.

Note that, the spray nozzle 1 shown in FIG. 3(*a*) is an oblong nozzle where the spray region 2 becomes an oblong long in one direction, while the spray nozzle 1 shown in FIG. 3(*b*) is a full cone nozzle where the spray region 2 becomes a circle. As a result, as shown in FIG. 4, regardless of the types, specifications, and spray regions of the nozzles, representation by the same relation becomes possible. By entering into the following equation <1> the cooling water impact pressure P [MPa], it is possible to find the heat transfer coefficient h[W/(m$^2$·K)].

$$h=33300\times P^{0.1} \quad <1>$$

In this test, the result was that the heat transfer coefficient was proportional to the 0.1 power of the cooling water impact pressure, but if considering measurement error etc., the heat transfer coefficient may be considered proportional to the n power of the cooling water impact pressure and the value of n may be considered to be in the range of 0.05 to 0.2.

This shows that the present invention is not dependent on the type or specifications of the nozzles and is effective even for a cooling apparatus using two or more types of nozzle differing in types and specifications of nozzles.

Further, the inventors investigated the relationship between the cooling uniformity in the direction perpendicular to processing and the cooling water impact pressure in the case of cooling a moving cooled member using a plurality of nozzles.

Figure 5A:
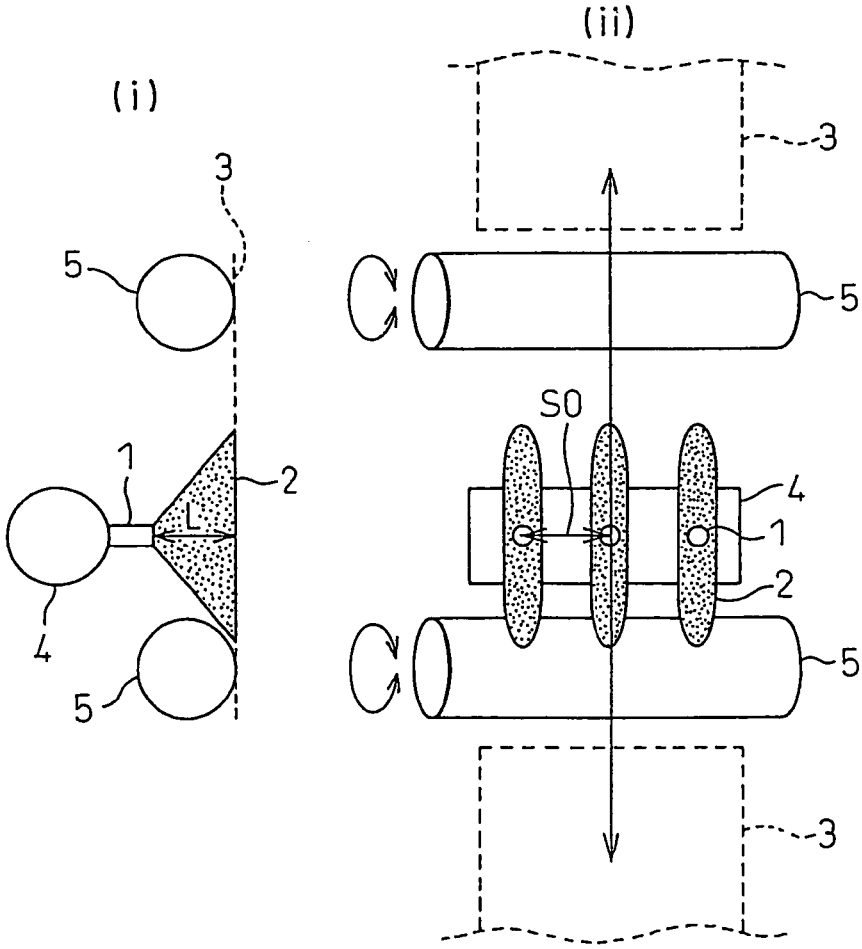
FIG. 5(*a*) gives a (i) side view and (ii) front view for explaining a cooling test apparatus arranging one line of nozzles in the direction perpendicular to processing.
Figure 5B:
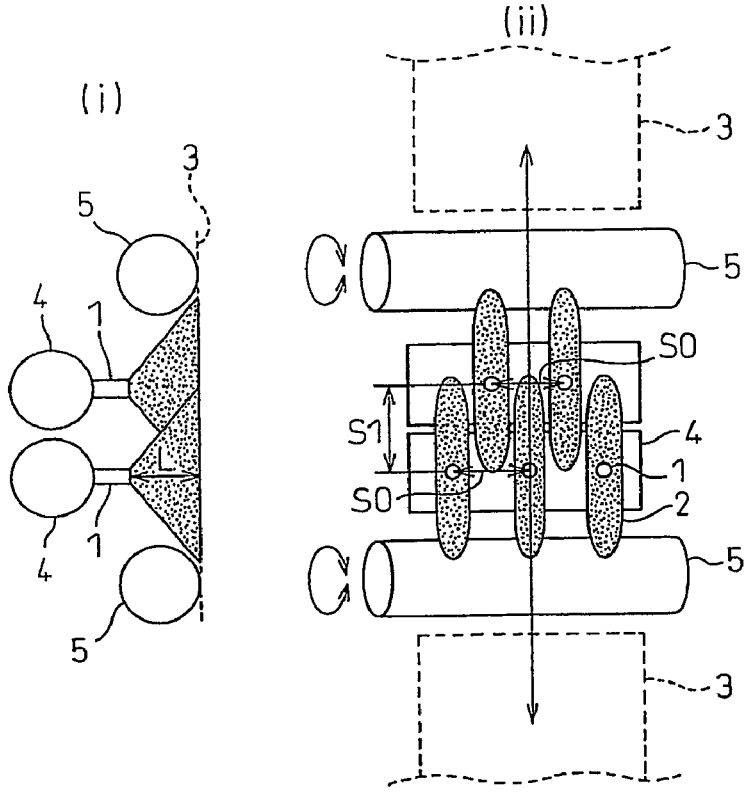

FIG. 5(*a*) and FIG. 5(*b*) show the cooling test apparatus in brief. As shown in FIG. 5(*a*), between front and back pairs of constraining rolls 5, 5 conveying steel plate as a cooled member 3, the inventors arranged three oblong nozzles (spray nozzles 1), with oblong shaped spray regions, facing upward at a nozzle pitch S0 of 150 mm in a direction perpendicular to processing, set the cooled member 3 so that the distance between the front ends of the nozzles and the cooled member 3 became 150 mm, and moved the cooled member 3 at a speed of 1 m/sec for a cooling test. Further, as shown in FIG. 5(*b*), they arranged five oblong nozzles (spray nozzles 1) facing upward at a nozzle pitch S0 of 150 mm and a pitch S1 in the processing direction of 200 mm in a zigzag configuration and ran a similar cooling test. Note that regarding the cooling ability, in the same way as the case of FIG. 2, the inventors ran a cooling test using as the cooled member 3 a plate thickness 20 mm rolled steel material for general structures (SS400) heated to 900° C. The heat transfer coefficient measured at a surface temperature of the steel material of 300° C. was used for evaluation as the cooling ability. Note that each spray nozzle 1 is supplied with cooling water through a header 4.

The cooling water impact pressure was measured by arranging pressure sensors at 20 mm intervals in the direction perpendicular to processing at the surface of the not heated cooled member 3 struck by the cooling water in the nozzle arrangement of FIG. 5(*a*) and FIG. 5(*b*), continuously measuring the impact pressure of the cooling water at intervals of 0.01 sec while moving the cooled member 3 by a speed of 1 m/sec, and deriving the integrated value of 0.1 power of the impact pressure of the cooling water measured between the pairs of constraining rolls 5, 5. Further, they divided this by the maximum integrated value in the direction perpendicular to the processing to render it dimensionless (normalized it) and found the distribution of impact pressure of cooling water in the direction perpendicular to processing.

Figure 6A:
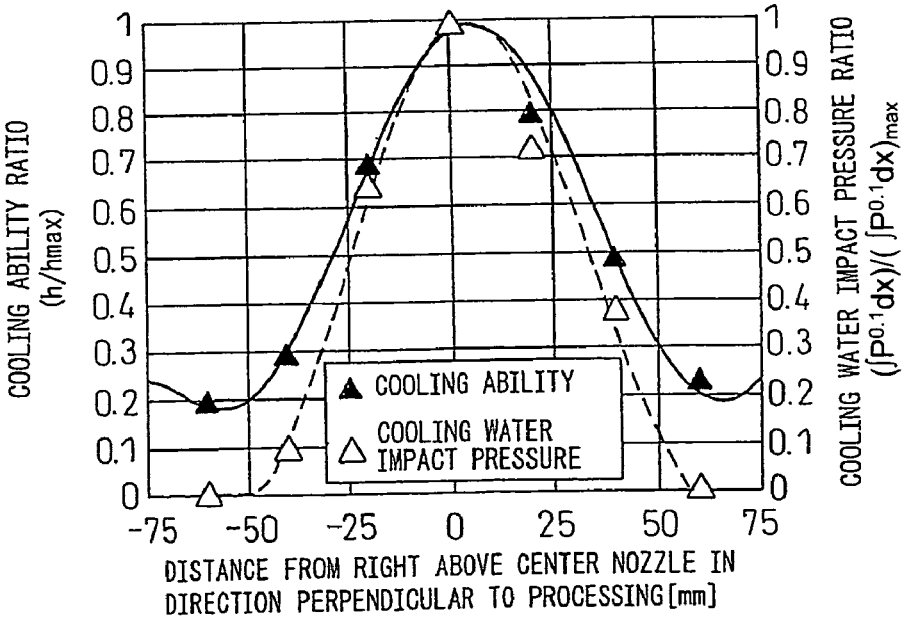
FIG. 6(*a*) is a graph showing the distribution of cooling ability and distribution of values of 0.1 power of cooling water impact pressure integrated in the processing direction normalized by the maximum integrated value in the direction perpendicular to processing in the nozzle arrangement of FIG. 5(*a*).
Figure 6B:
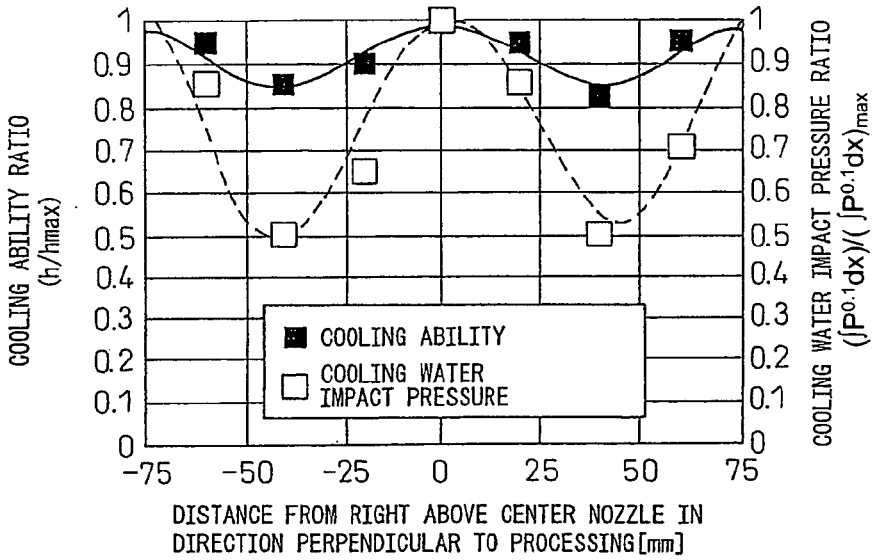

The distribution of cooling ability and distribution of impact pressure of cooling water in the direction perpendicular to processing in the nozzle arrangement of FIG. 5(*a*) are shown in FIG. 6(*a*). Further, the distribution of cooling ability and distribution of impact pressure of cooling water in the direction perpendicular to processing in the nozzle arrangement of FIG. 5(*b*) are shown in FIG. 6(*b*). The coordinates of these figures indicate the value of the cooling ability divided by the value of the maximum cooling ability to render it dimensionless (normalize it) and the value of 0.1 power of the cooling water impact pressure integrated in the processing direction divided by the maximum integrated value in the direction perpendicular to the processing to render it dimensionless (normalize it). From FIG. 6(*a*), the area near 0 mm which becomes right above a nozzle becomes greatest in cooling water impact pressure and cooling ability, while the areas of ±50 to 75 mm between the nozzles becomes smallest in cooling water impact pressure and cooling ability. A similar trend, though differing somewhat in extent, is exhibited in FIG. 6(*b*) as well, so it is learned that the distribution of the cooling ability in the direction perpendicular to processing and the distribution of the values of 0.1 power of the cooling water impact pressures integrated in the processing direction match well.

The inventors changed the nozzle pitch S0 in the direction perpendicular to processing using this configuration and investigated the relationship between the distribution of cooling ability in the direction perpendicular to processing and the distribution in the direction perpendicular to processing of the values of the 0.1 power of the cooling water impact pressure integrated in the processing direction. They found the distribution of impact pressure of cooling water required for realizing uniform cooling in the direction perpendicular to processing. As a result, the inventors discovered that, as shown in FIG. 7, by arranging the spray nozzles so that the lowest value of 0.1 power of the impact pressure of the cooling water on the cooling surface integrated in the processing direction becomes within −20% of the highest value in the direction perpendicular to processing, the lowest cooling ability can be kept within at least 10% of the highest cooling ability in the direction perpendicular to processing and uniform cooling becomes possible.

Figure 7:
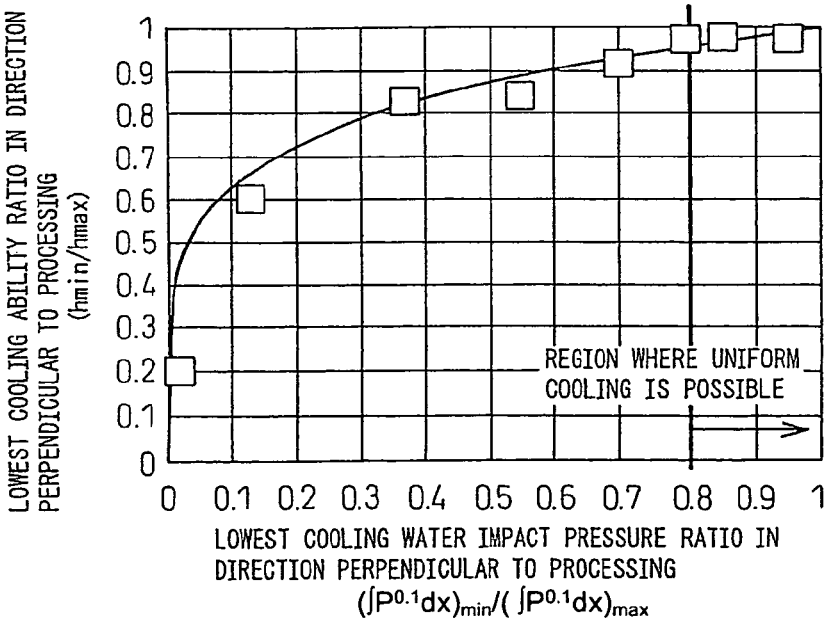
FIG. 7 is a graph showing the relationship between the ratio of the lowest value and highest value, in the direction perpendicular to processing, of 0.1 power of the impact pressures of the cooling water on the cooling surface integrated in the processing direction and the ratio of the lowest value and highest value of cooling ability in the direction perpendicular to processing.

The study of this FIG. 7 was performed changing the 0.1 power to the 0.05 power and the 0.2 power, but if keeping the value of the respective power of integrated value of the cooling water impact pressure within −20% of the highest value in the direction perpendicular to processing, uniform cooling becomes possible in the direction perpendicular to processing in substantially the same way as the time of the power of 0.1. From this, it can be said that the distribution in the direction perpendicular to processing of the integrated value of the impact pressure of the cooling water on the cooling surface to the 0.05 to 0.2 power becomes an indicator for uniform cooling in the direction perpendicular to processing.

Further, regarding the range in which integration is possible in the processing direction, the inventors changed the nozzle pitch S1 in the processing direction and investigated the results, whereupon they discovered that when the processing speed is 0.25 m/sec to 2 m/sec and when the length between pairs of constraining rolls 5, 5 is 2 m or less, it is desirable to make the range of integration the entire length between pairs of constraining rolls.

Figure 8:
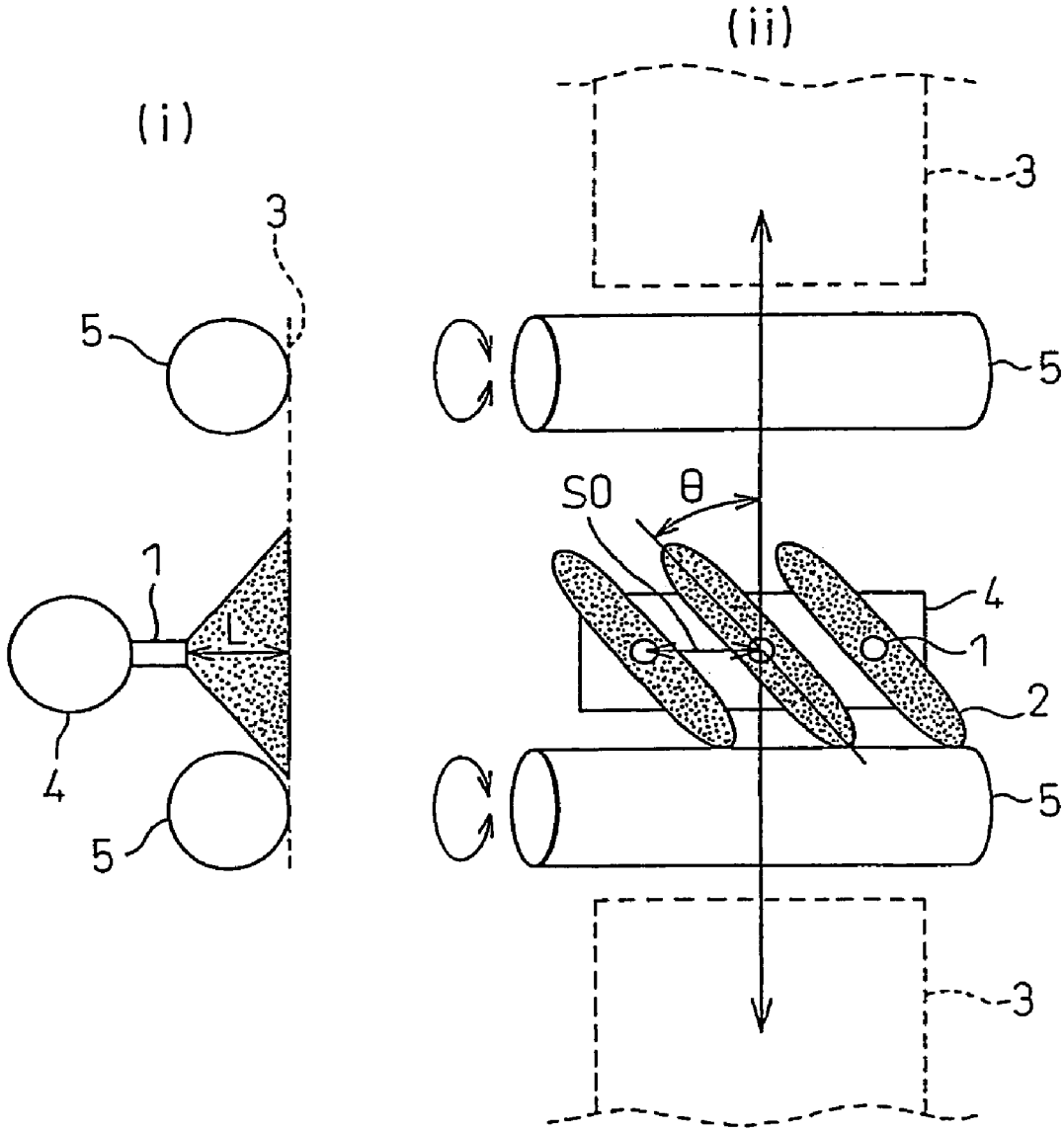
FIG. 8 gives a (i) side view and (ii) front view for explaining a cooling test apparatus arranging nozzles having a torsional angle in one line.
Figure 9:
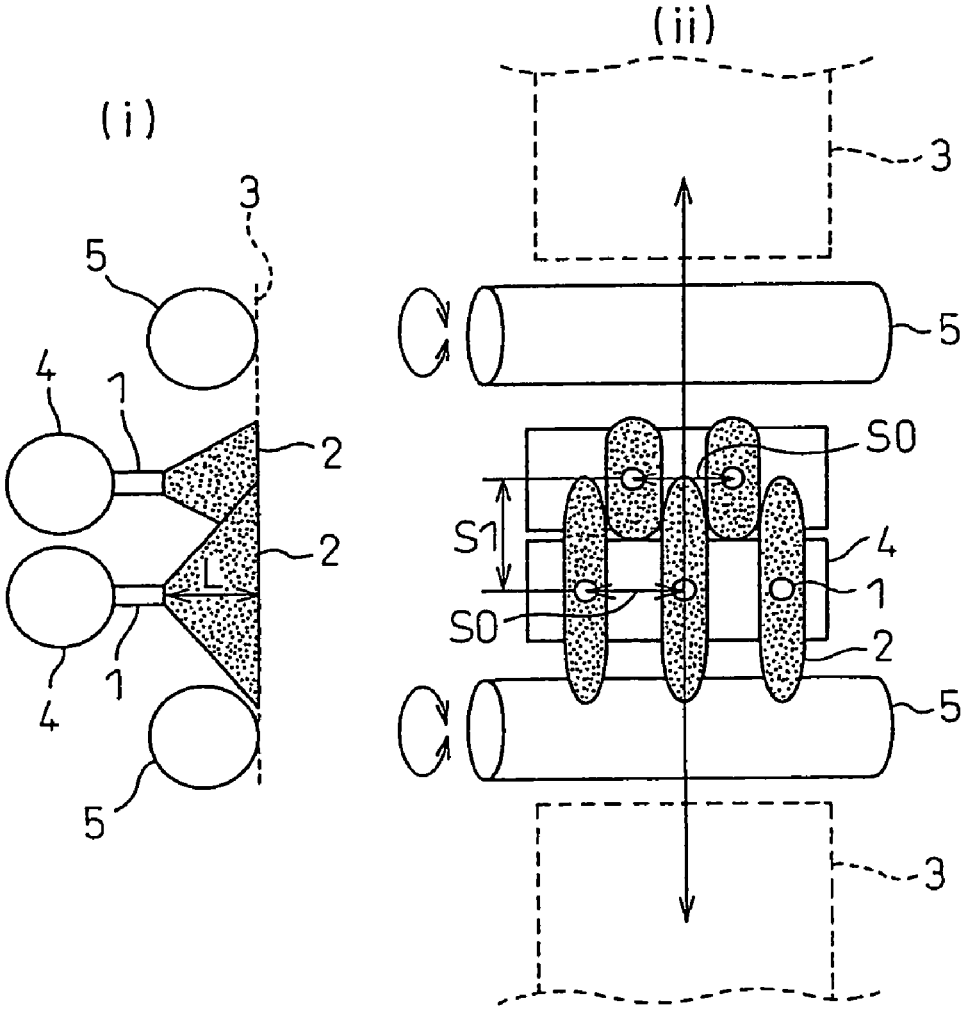
FIG. 9 gives a (i) side view and (ii) front view for explaining a cooling test apparatus arranging spray nozzles of different types and specifications in two lines.

Note that, as shown in FIG. 8, even if not changing the nozzle pitch S0 in the direction perpendicular to processing, but changing the nozzle torsion angle θ, as shown in FIG. 9, even when using two or more types of nozzles differing in amounts of water and spray regions in combination, uniform cooling in the direction perpendicular to processing can be achieved by arranging the spray nozzles so that the value of 0.1 power of the impact pressure of the cooling water on the cooling surface integrated in the processing direction becomes within −20% of the highest value in the direction perpendicular to processing.

Further, when no interference regions of cooling water occur, it is possible to measure or create standard formulas for the impact pressure of cooling water for individual types and specifications of nozzles arranged, find the distribution of impact pressure of cooling water for the case of virtually arranging a plurality of these nozzles, and set the arrangement so that the value of 0.1 power of the impact pressure of cooling water integrated in the processing direction becomes within −20% of the highest value of the direction perpendicular to processing so as to achieve uniform cooling in the direction perpendicular to the processing direction.

Further, even when spraying mixed water and air, by arranging the nozzles so that the value of 0.1 power of the impact pressure on the cooling surface added in the processing direction becomes within −20% of the highest value in the direction perpendicular to processing, the lowest cooling ability is kept within about 10% of the highest cooling ability and uniform cooling in the direction perpendicular to processing can be achieved.

EXAMPLES

Figure 10A:
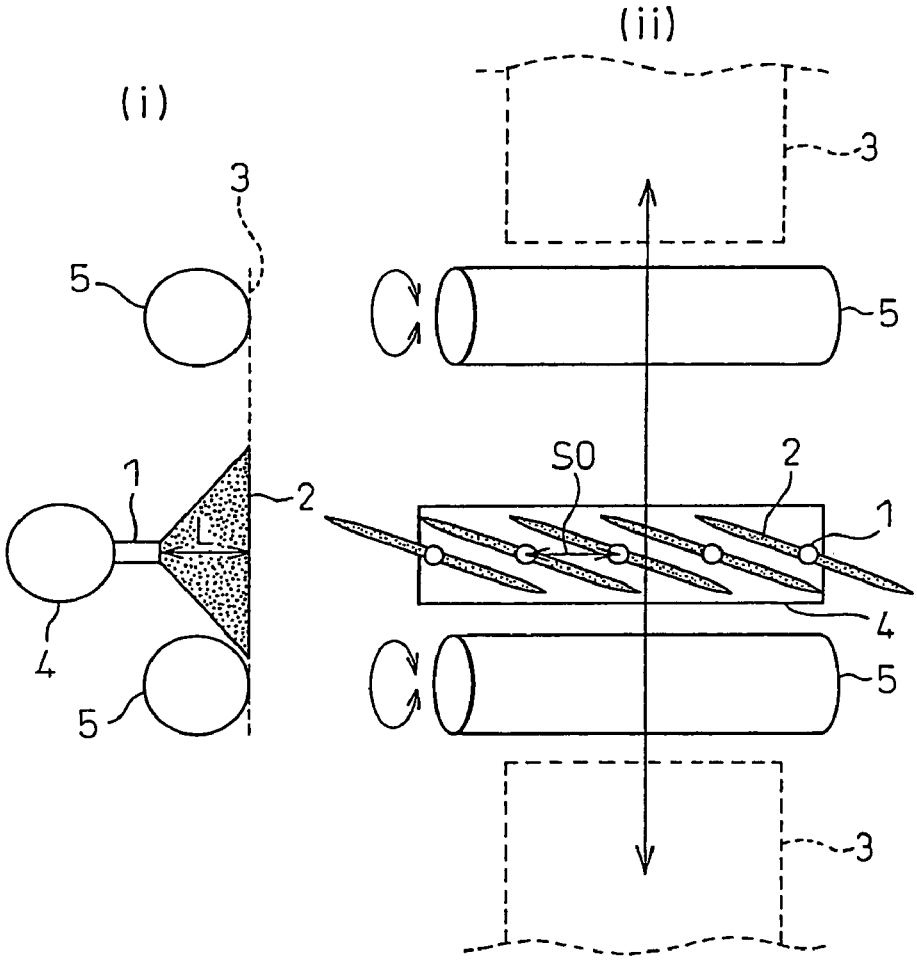
FIG. 10(*a*) gives a (i) side view and (ii) front view for explaining a cooling test apparatus used for studying the present invention, that is, a cooling test apparatus using a conventional method of setting spray nozzles.
Figure 10B:
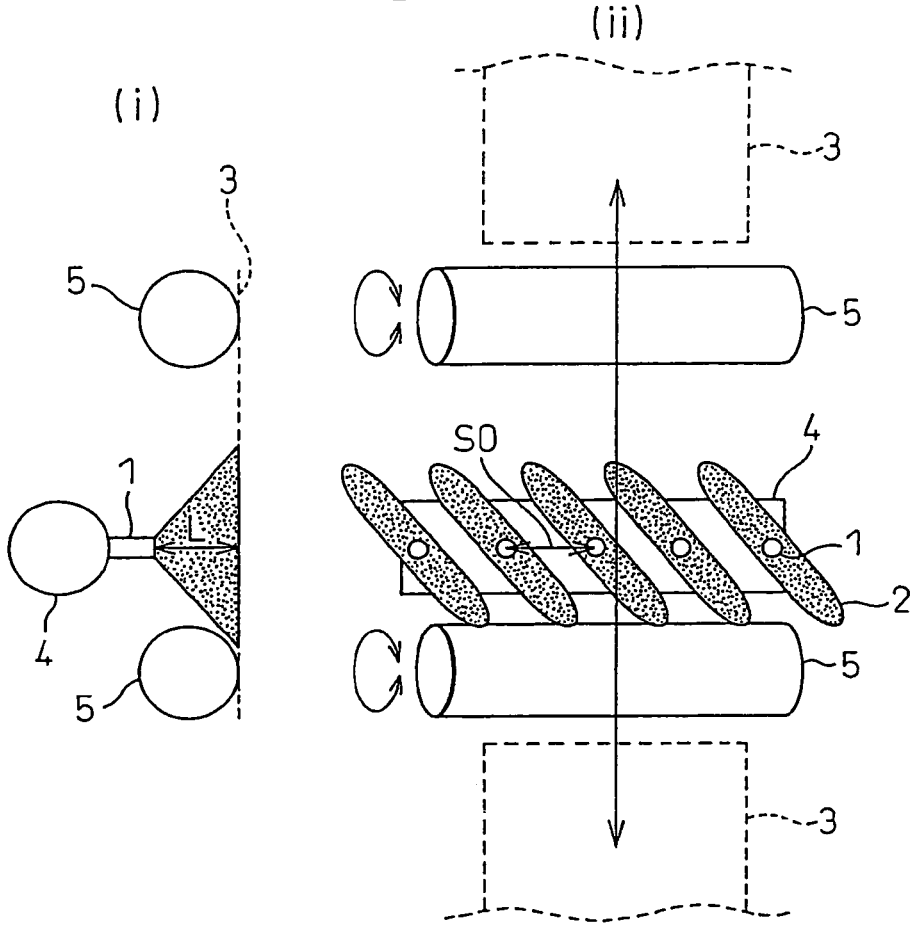
Figure 11A:
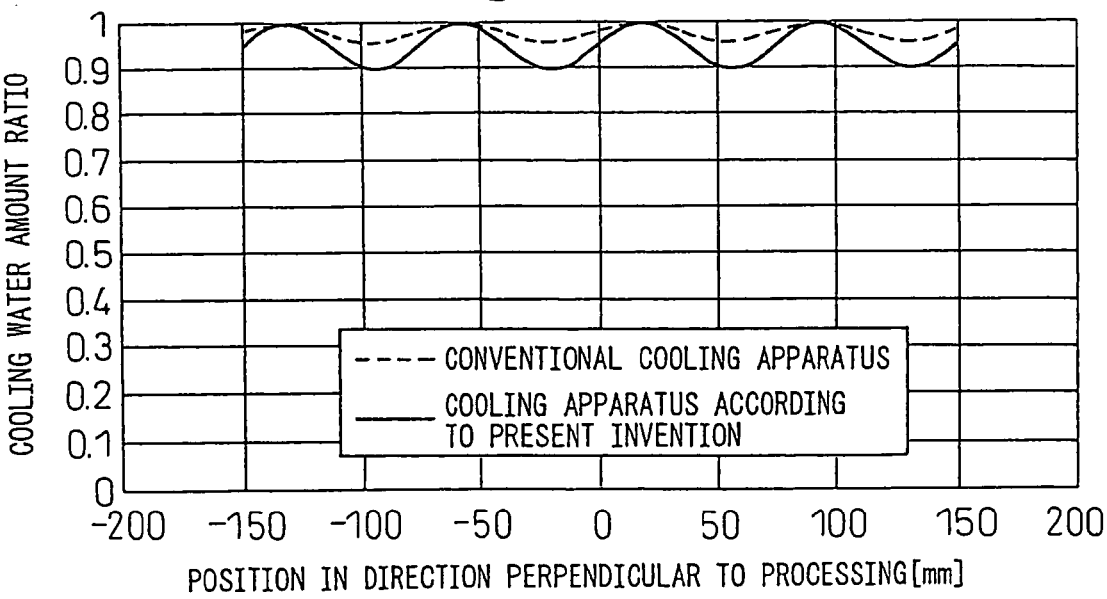
FIG. 11(*a*) is a graph comparing the distribution of amounts of water in the direction perpendicular to the steel plate between the cooling apparatus of the present invention and the conventional cooling apparatus.
Figure 11B:
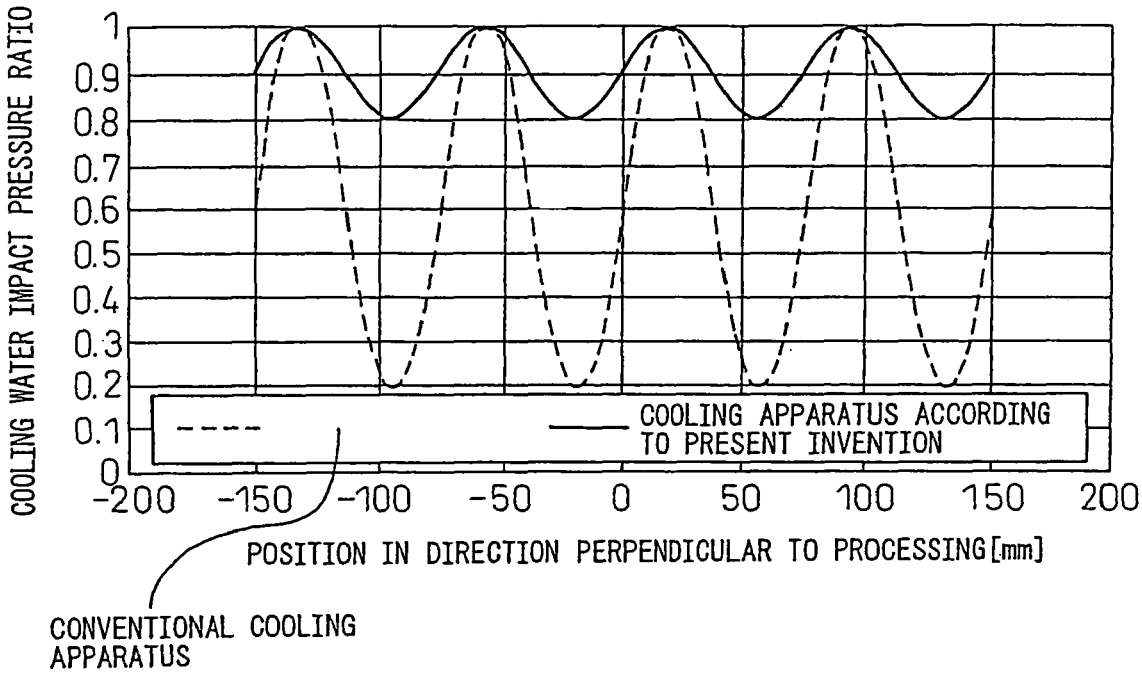
Figure 11C:
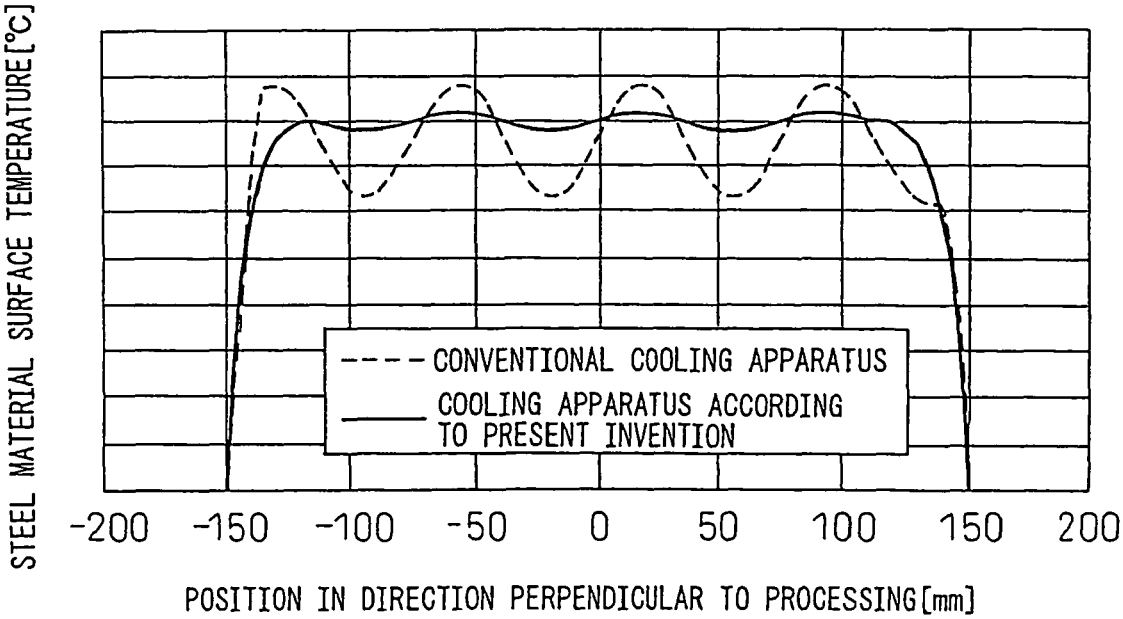

FIG. 10(*a*) and FIG. 10(*b*) show the arrangement of spray nozzles in a cooling test apparatus used for the study of the present invention. FIG. 10(*a*) shows a cooling apparatus arranging flat nozzles (spray nozzles 1) by the conventional method of arranging and setting spray nozzles so that the amounts of cooling water become the same in the direction perpendicular to processing, while FIG. 10(*b*) shows a cooling apparatus arranging oblong nozzles (spray nozzles 1) by the method of arranging and setting spray nozzles of the present invention so that the value of the n power of the impact pressures of the cooling water integrated in the processing direction becomes within −20% of the highest value in the direction perpendicular to processing. In this example, n=0.1. These cooling apparatuses were used for cooling tests and compared against each other. These used the same nozzle arrangements (S0=75 mm, L=150 mm) and amounts of water to cool rolled steel materials for general structures (SS400) of thickness 20 mm×width 300 mm×length 200 mm from approximately 900° C. to approximately 400° C. for approximately 20 seconds. The ratios of these amounts of water, the ratios of the 0.1 powers of the cooling water impact pressures, and a comparison of the distribution of surface temperatures after cooling are shown in FIG. 11(*a*), FIG. 11(*b*), and FIG. 11(*c*). Note that the distribution of surface temperature after cooling was measured using a radiant thermometer.

As clear from FIG. 11(*a*), FIG. 11(*b*), and FIG. 11(*c*), in the conventional method of arranging spray nozzles, compared with the method of the present invention of arranging spray nozzles, the distribution of cooling water amounts in the direction perpendicular to processing is uniform, but uneven temperature occurs at the same pitch as the pitch of spray nozzles. However, the method of arranging spray nozzles of the present invention where the value of the 0.1 power of the cooling water impact pressures integrated in the processing direction becomes within −20% of the highest value in the direction perpendicular to processing results in a more uniform distribution of surface temperatures than the conventional spray nozzle arrangement. Therefore, in a cooling apparatus where the nozzle arrangement is set by the method of setting spray nozzles of the present invention, uniform cooling in the direction perpendicular to processing is possible.

INDUSTRIAL APPLICABILITY

According to the present invention, in a cooling apparatus using spray nozzles, by employing nozzle types and nozzle arrangements defining as the cooling factor the never previously considered cooling water impact pressure, it is possible to fabricate a cooling apparatus having a high cooling uniformity in the direction perpendicular to processing.

That is, it is possible to categorize the cooling ability by the cooling factor of the cooling water impact pressure, so when experimentally setting a nozzle arrangement, even if not actually using a hot slab to run a cooling test, it is possible to find a nozzle arrangement giving a high cooling uniformity in the direction perpendicular to processing by experimentally obtaining the distribution in the direction perpendicular to processing of the value of the n power of the impact pressures integrated in the processing direction. Further, if knowing the distribution of pressure at the impact surface for the nozzles used, it is possible to find a nozzle arrangement giving a high cooling uniformity in the direction perpendicular to processing by calculating the distribution in the direction perpendicular to processing of the value of the n power of the impact pressures integrated in the processing direction.

Further, according to the method of arranging and setting spray nozzles of the present invention, even if using two or more types of nozzles differing in amounts of water and spray regions, a similar cooling uniformity is achieved in the direction perpendicular to processing, so it is possible to realize a spray cooling apparatus having a uniform cooling ability in the direction perpendicular to processing and having a broad range of adjustment of the amounts of water.

Further, the present invention enables a spray nozzle arrangement to be set which can realize cooling uniformity in the same way even in spray nozzles having structures enabling mixed spraying of water and air.

The invention claimed is:

1. A method of arranging and setting spray nozzles of a processing and cooling apparatus provided with a plurality of pairs of constraining rolls for constraining and processing hot steel plate and a plurality of lines of spray nozzles, able to control the amounts of cooling water sprayed, between pairs of constraining rolls in the processing direction and/or direction perpendicular to processing for cooling the hot steel plate uniformly in the direction perpendicular to the processing direction, said method characterized by arranging and setting the spray nozzles so that a distribution of values of n power of the impact pressure P of the cooling water on the cooling surface, P", integrated in the processing direction between pairs of constraining rolls becomes within −20% of the highest value in the direction perpendicular to processing, where, $0.05 \leqq n \leqq 0.2$, and characterized by using a plurality of types of nozzles differing in amounts of water or spray regions of cooling water for each line of nozzles between pairs of constraining rolls.

2. A method of arranging and setting spray nozzles as set forth in claim 1, characterized in that the spray nozzles have structures enabling mixed spraying of water and air.

3. A hot steel plate cooling apparatus characterized by setting the arrangement of spray nozzles using the method as set forth in claim 1.

* * * * *